US007665501B2

(12) United States Patent
Colson

(10) Patent No.: US 7,665,501 B2
(45) Date of Patent: Feb. 23, 2010

(54) DRAW CORD ARRANGEMENT

(75) Inventor: Wendell B. Colson, Weston, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 157 days.

(21) Appl. No.: 11/541,088

(22) Filed: Sep. 29, 2006

(65) Prior Publication Data

US 2007/0074828 A1 Apr. 5, 2007

Related U.S. Application Data

(60) Provisional application No. 60/723,117, filed on Oct. 3, 2005.

(51) Int. Cl.
*E06B 9/36* (2006.01)

(52) U.S. Cl. ..... 160/168.1 V; 160/345

(58) Field of Classification Search ..... 160/173 V, 160/177 V, 168.1 V, 321, 345, 900
See application file for complete search history.

(56) References Cited

U.S. PATENT DOCUMENTS

| | | | | |
|---|---|---|---|---|
| 1,530,068 | A | 3/1925 | Abrott | |
| 2,591,775 | A * | 4/1952 | Bopp et al. | 160/168.1 V |
| 2,759,534 | A * | 8/1956 | Harju | 160/168.1 V |
| 3,818,543 | A * | 6/1974 | Baker, Sr. | 16/87.4 R |
| 4,276,920 | A * | 7/1981 | Comeau | 160/345 |
| 4,381,812 | A * | 5/1983 | Ford et al. | 160/172 R |
| 4,425,955 | A * | 1/1984 | Kaucic | 160/168.1 V |
| 4,736,784 | A * | 4/1988 | Boloix | 160/168.1 V |
| 4,751,953 | A * | 6/1988 | Appel et al. | 160/313 |
| 4,754,796 | A * | 7/1988 | Ciriaci | 160/173 R |
| 4,785,866 | A * | 11/1988 | Darner | 160/345 |
| 4,834,163 | A * | 5/1989 | Dickstein | 160/176.1 R |
| 4,844,139 | A * | 7/1989 | John | 160/168.1 V |
| 4,936,370 | A * | 6/1990 | Uecker et al. | 160/168.1 V |
| 5,090,467 | A * | 2/1992 | Smuckler | 160/176.1 V |
| 5,413,162 | A * | 5/1995 | Ciriaci | 160/177 V |
| 5,445,205 | A * | 8/1995 | Hansen | 160/168.1 R |

FOREIGN PATENT DOCUMENTS

| | | |
|---|---|---|
| EP | 0 098 146 A2 | 1/1984 |
| GB | 1 261 370 | 1/1972 |

* cited by examiner

*Primary Examiner*—David Purol
(74) *Attorney, Agent, or Firm*—Day Pitney LLP

(57) ABSTRACT

A covering for an architectural opening includes a cord which forms a loop hanging from one of the two ends of the headrail by which it is mounted. The loop is used to open and close the material suspended from the headrail and in front of the architectural opening. The cord extends within the headrail between its two ends, and may be pulled from the end lacking the loop in order to move the loop from one side to the other.

9 Claims, 5 Drawing Sheets

DRAW CORD ARRANGEMENT

CROSS REFERENCE TO RELATED APPLICATION

This application is based on U.S. Patent Application Ser. No. 60/723,117, filed Oct. 3, 2005, a provisional application upon which a claim for priority in the present application is based.

BACKGROUND OF THE INVENTION

1. Field of the Invention

The present invention relates to vertically hanging coverings for architectural openings, such as doors and windows. More specifically, the present invention relates to coverings of this variety which may be opened and closed by manipulating a vertically hanging loop of cord on one of the two sides of the covering.

2. Description of the Prior-Art

Coverings of the subject type are well known in the art. One disadvantage of such coverings is that they must be provided with the loop of cord required for opening and closing operation in either right- or left-hand variants. That is to say, a manufacturer must provide variants of a given model of covering with the loop of cord on either the right- or left-hand side. Needless to say, this requires the maintenance of an inventory of both variants of a given model.

Moreover, a customer may often want to change a covering previously installed in his home from a right-hand variant to a left-hand variant, or vice versa. Such a change might require a time-consuming and complicated disassembly of the covering, once it has been removed from above the architectural opening, and reassembly into the desired mode, followed by reinstallation.

Both manufacturers and customers would clearly benefit from a covering which could be readily changed between right- and left-hand variants, particularly if this could be accomplished without taking the covering down from over the architectural opening. That benefit is provided by the present invention.

SUMMARY OF THE INVENTION

Accordingly, the present invention is a covering for an architectural opening. The covering comprises a headrail which is mountable above an architectural opening. The headrail has an interior, and a first end and a second end.

At each end of the headrail is a means for guiding a cord. Each means for guiding includes a first opening and a second opening which communicate with the interior of the headrail.

Material of some kind is suspended from the headrail for covering the architectural opening. A mechanism is disposed within the headrail for alternately covering and uncovering the architectural opening with the material.

The mechanism may be any one of those conventionally used by those of ordinary skill in the art to operate coverings for architectural openings, such as coverings of the stacking-panel type, Venetian blinds, roll-up shades, curtains and the like. As such, the material suspended from the headrail may be that of any of these coverings, and the mechanism may operate with any of the various conventional cord operating devices.

Finally, a cord, having a first end and second end, is included for operating the covering. The first and second ends of the cord are attached, perhaps tied, to the mechanism within the headrail. The cord runs in the following manner:

starting from the first end attached to the mechanism, it runs down the headrail and outwardly through the first opening of the means for guiding at the first end of the headrail; then it enters through the second opening of the means for guiding at the first end of the headrail and runs lengthwise through the interior of the headrail to the second end thereof, exiting through the first opening of the means for guiding at the second end; then the cord re-enters through the second opening of the means for guiding at the second end of the headrail and continues to the second end at the mechanism. The cord has sufficient slack to form a loop at one of said first and second ends of the headrail to enable the cord to be pulled to alternately cover and uncover the architectural opening with the material suspended from the headrail.

The present invention will now be described in more detail with frequent reference being made to the figures identified below.

DETAILED DESCRIPTION OF THE PREFERRED EMBODIMENT

Figure 1:
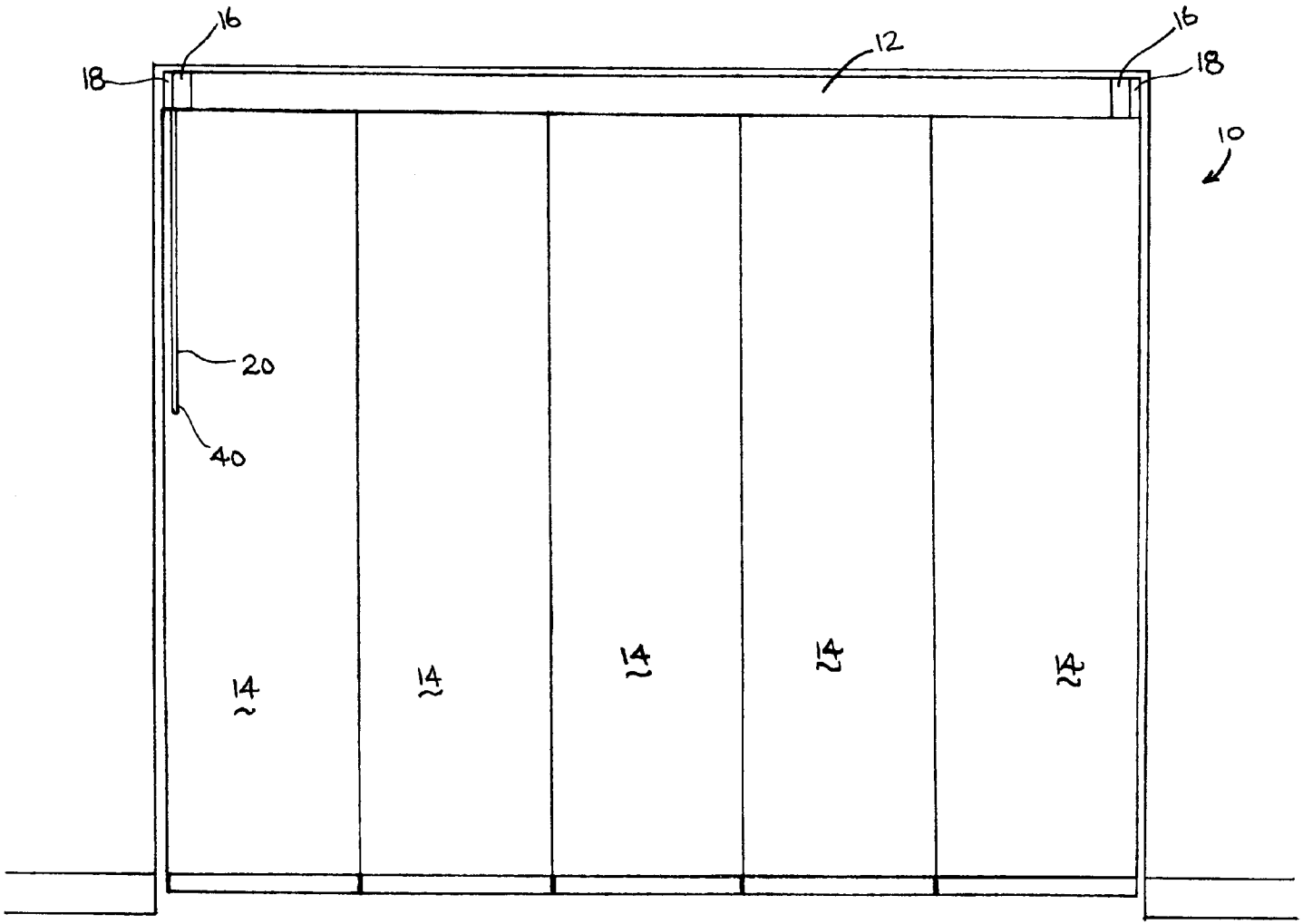
FIG. 1 is an elevational view of a covering for an architectural opening.

Turning now to these figures, FIG. 1 is an elevational view of a covering 10 for an architectural opening incorporating the present invention. As shown in FIG. 1, the covering 10 includes a headrail 12, by which it may be mounted or suspended across the top of an architectural opening. The architectural opening shown in FIG. 1 is a window or sliding door of essentially floor-to-ceiling height. However, this should not be understood by the reader to limit the present invention to coverings 10 used in architectural openings of that type, for it is equally applicable to windows and doors of all heights and widths.

The covering 10, as shown in FIG. 1, comprises a plurality of individual panels 14 suspended from the headrail 12. When the covering 10 is opened, the panels 14 form a stacked array on one of the two sides of the architectural opening. However, the present invention is not intended to be limited to use with coverings of the stacking-panel type, and may be applied to all varieties of blinds, roll-up shades, curtains and the like.

At each end of the headrail 12 is a cord-guiding member 16, whose structure and function will be described in complete detail below, and an end cap 18. Suspended from between the cord-guiding member 16 and end cap 18 at the left-hand end of the headrail 12 in FIG. 1 is a loop 40 of cord 20, which is used to open and close the covering 10.

Figure 2:
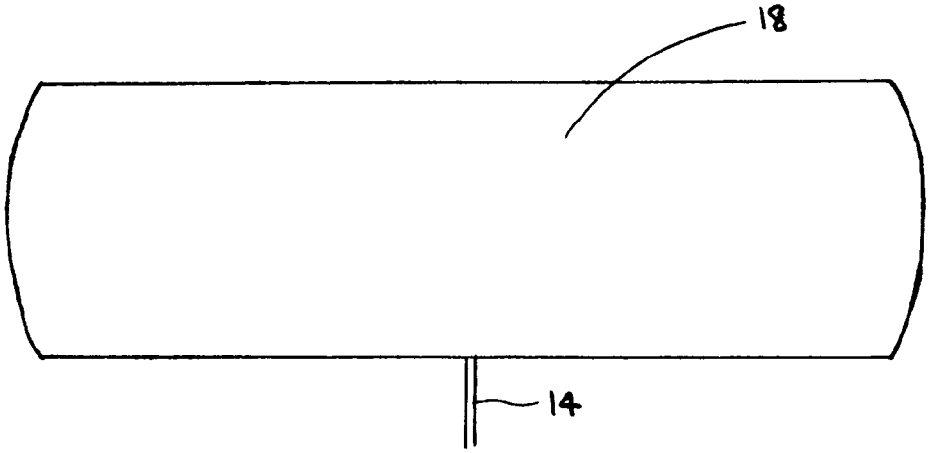
FIG. 2 is an elevational view of the covering taken from the right-hand side of FIG. 1.

FIG. 2 is an elevational view of the covering 10 taken from the right-hand end thereof in FIG. 1. End cap 18 covers the cord-guiding member 16; a portion of a panel 14 is shown hanging below. When end cap 18 as shown in FIG. 2 is removed, cord-guiding member 16 appears as shown in FIG. 3.

Figure 3:
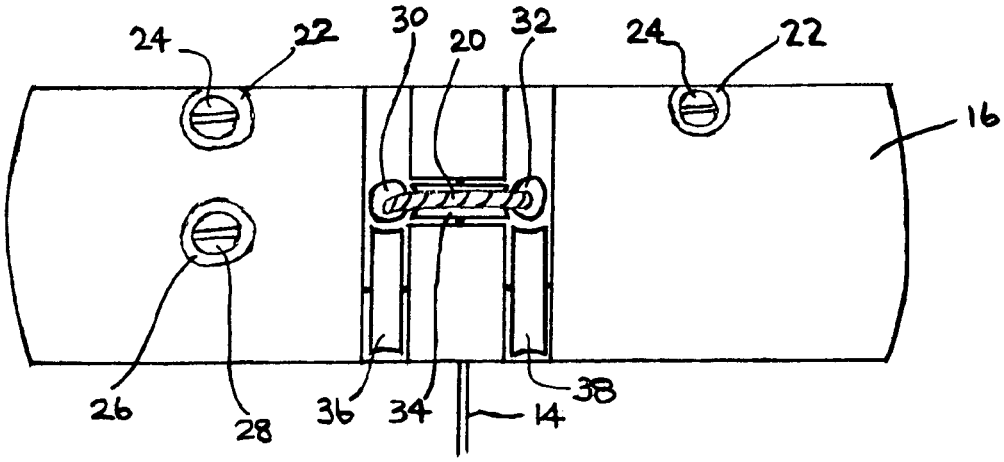
FIG. 3 is the elevational view of FIG. 2 after the end cap has been removed.

As seen in the elevational view of FIG. 3, cord-guiding member 16 has two holes 22 at the bottom of which may be screws 24 or the like used to attach the cord-guiding member 16 to the headrail 12. A further hole 26 may be provided in cord-guiding member 16, so that screw 28 or the like may be disposed therein and used to immobilize the rightmost panel 14 in FIG. 1 at the right-hand end of the headrail 12. In that event, panels 14 form a stacked array at that end of the headrail 12 when the covering 10 is opened.

Cord 20 in FIG. 3 passes outwardly from within headrail 12, which is not visible in FIG. 3, but rather is hidden by cord-guiding member 16, through hole 30 and re-enters through hole 32. Between holes 30, 32 is a roller 34, which may alternatively be a pulley. Roller 34, which is rotatable about a vertical axis, enables the cord 20 to pass readily out of hole 30 and into hole 32, or vice versa, when the loop of cord 20 at the left-hand side of FIG. 1 is manipulated to open or close the covering 10.

The cord-guiding member 16 also has rollers 36, 38, which may alternatively be pulleys, disposed below holes 30, 32, respectively. The purpose of rollers 36, 38 will become clear with reference to FIG. 4.

Figure 4:
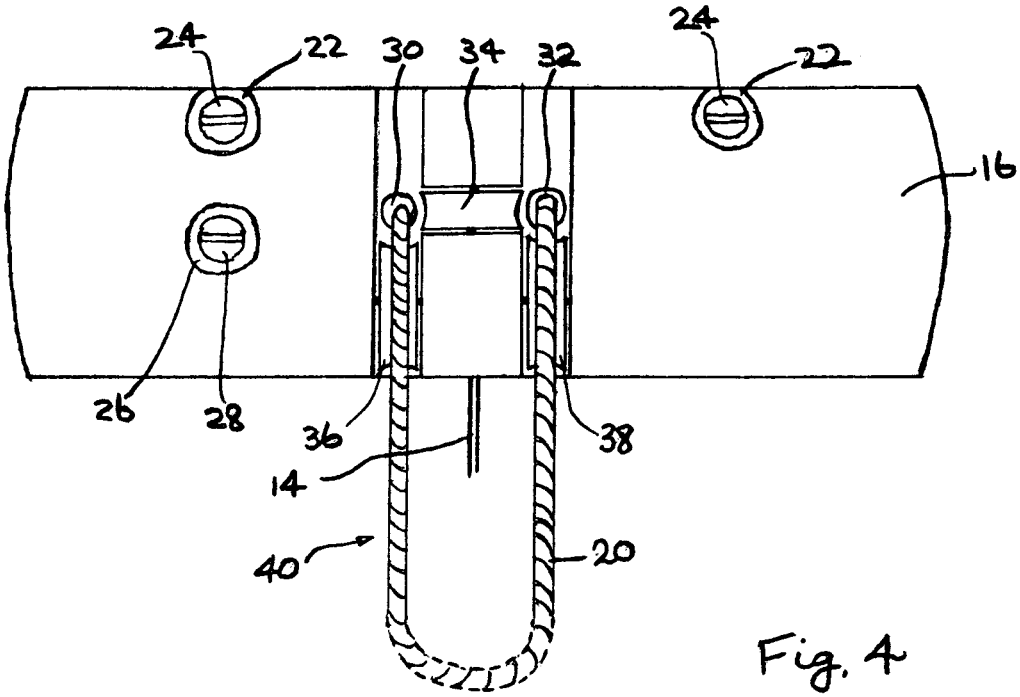
FIG. 4 is the elevational view of FIG. 3 with the cord pulled out to form a loop.
Figure 6:
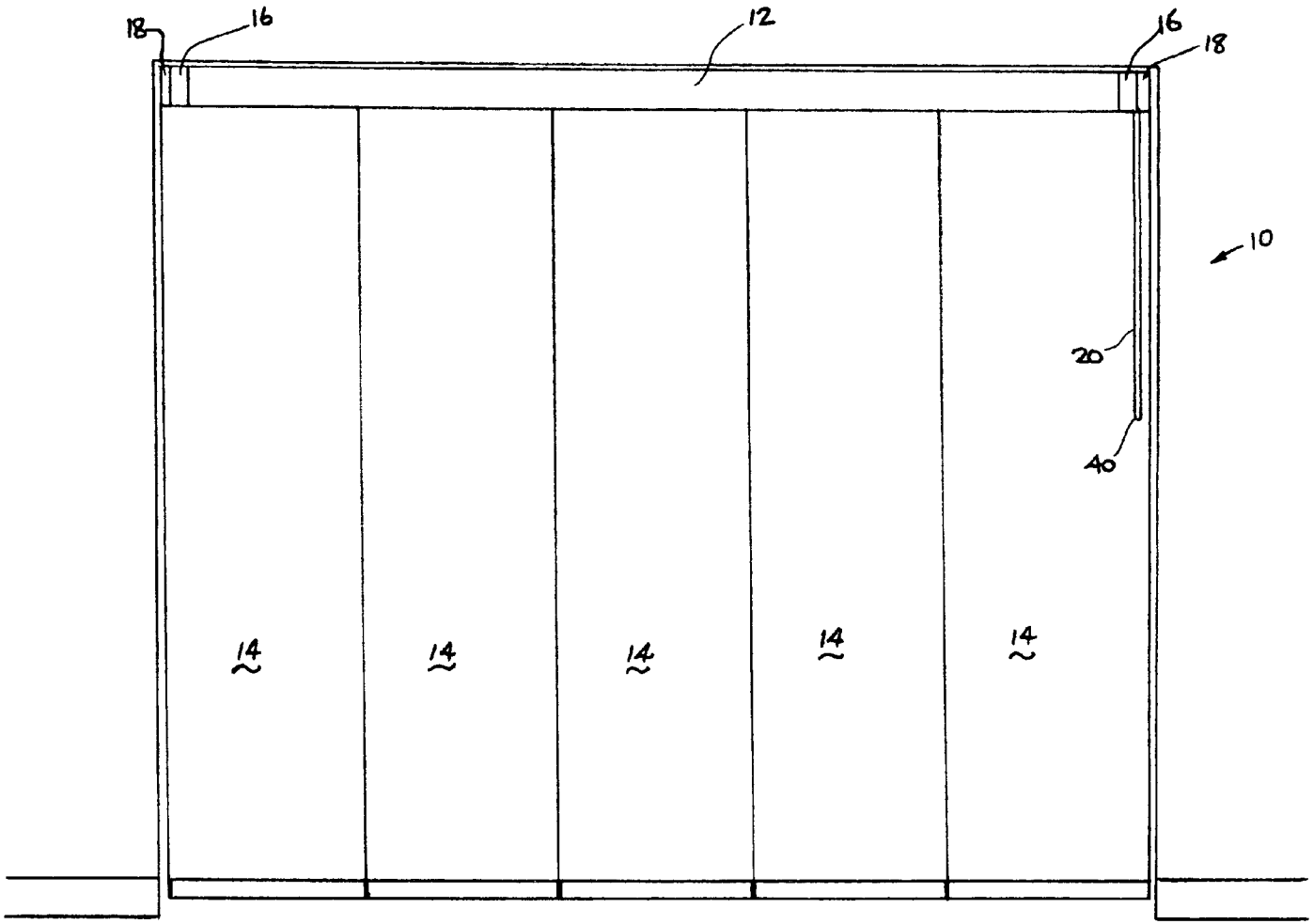
FIG. 6 is an elevational view of the covering with the cord loop at the end opposite from that shown in FIG. 1.

Cord 20, which loops around roller 34 in FIG. 3, may be grasped at roller 34 and pulled out through holes 30, 32 to produce the loop 40 shown in FIG. 4. In so doing, the loop, originally appearing in FIG. 1 on the left-hand side of the covering 10 is moved to the right-hand side ultimately to give the covering 10 the appearance it has in FIG. 6. In such a situation, rollers 36, 38 facilitate the manipulation of cord 20 using loop 40 to open and close the covering 10 from the right-hand side, as shown in FIG. 6. It should be understood that the cord-guiding member 16 at the left-hand end of the headrail 12 operates in the same fashion.

Figure 5:
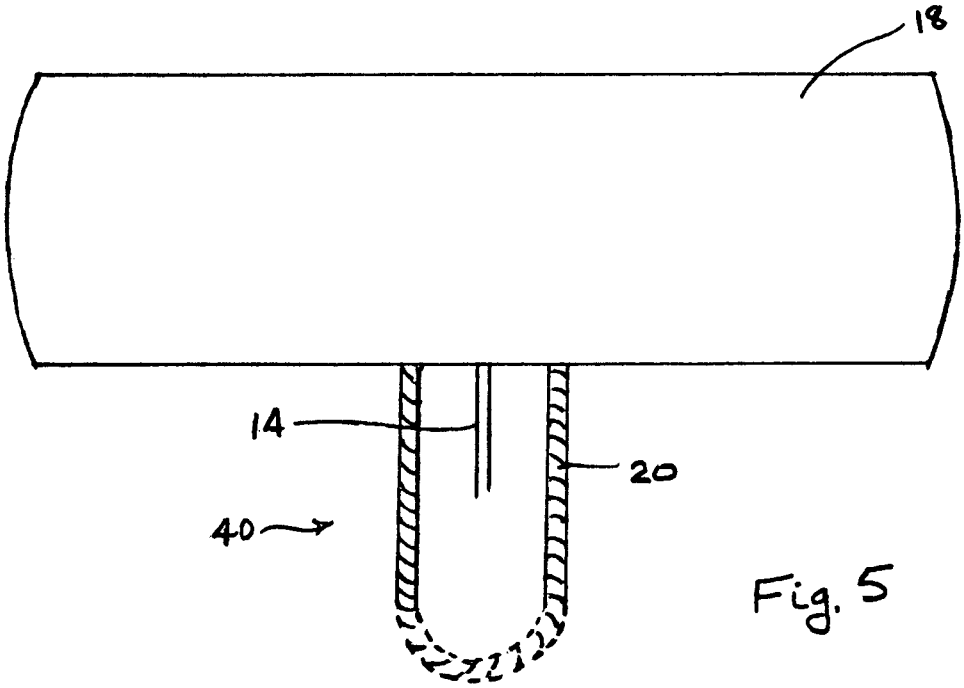
FIG. 5 is the elevational view of FIG. 4 with the end cap replaced.

FIG. 5 is an elevational view of the covering 10 taken from the right-hand end thereof when the end cap 18 has been replaced over cord-guiding member 16 in FIG. 4.

Figure 7:
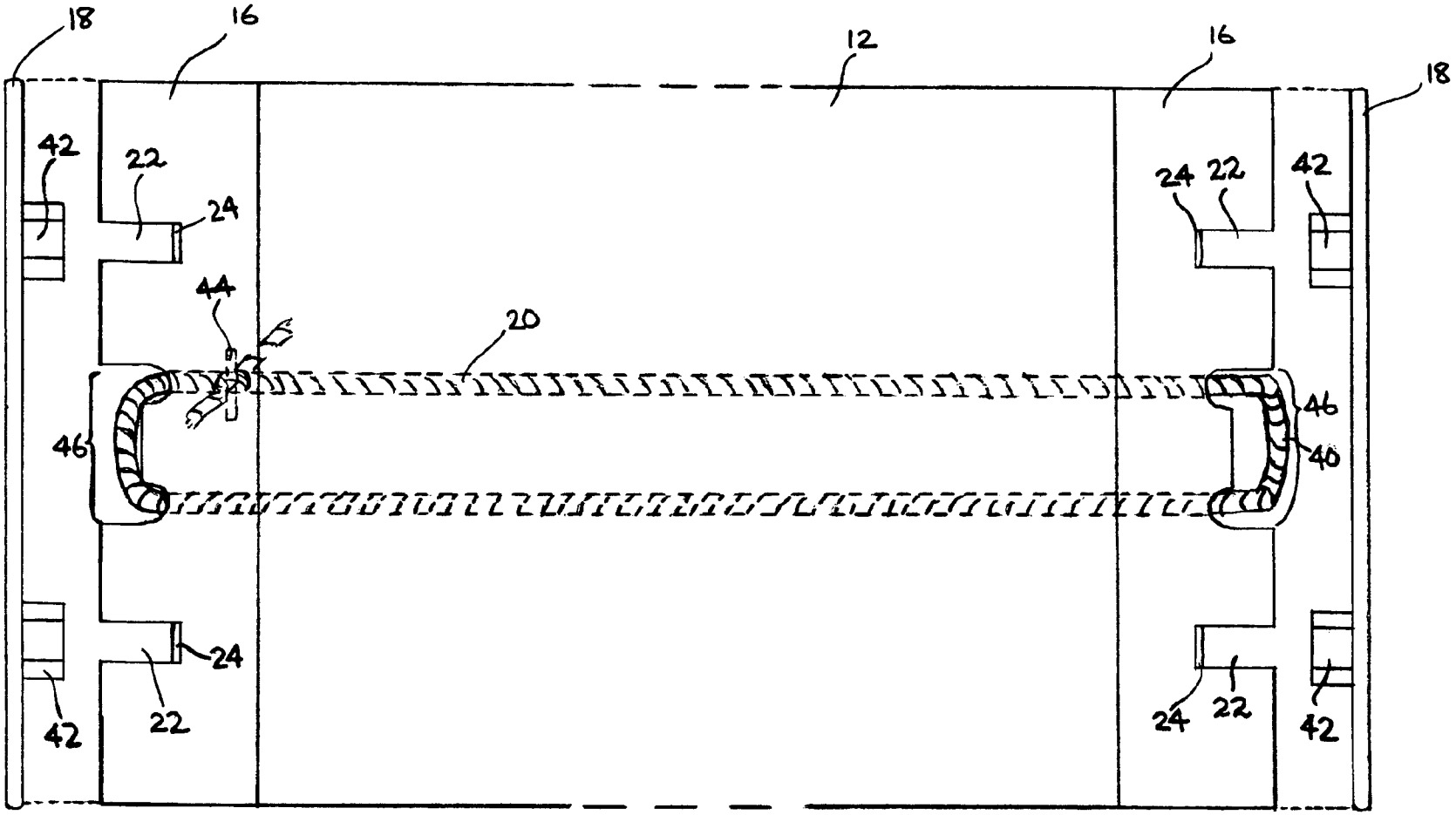
FIG. 7 is a view of the covering taken from above the headrail in FIG. 6.

FIG. 7 is a view of covering 10 taken from above the headrail in FIG. 6 with the end caps 18 exploded from the cord-guiding members 16 at both ends of the headrail 12. It may be seen in FIG. 7 that cord 20 has a portion which runs continuously from the left-hand end of the headrail 12 to the right-hand end, where it forms loop 40. One pulling at the cord 20 from the left-hand end can pull all of the cord 20 forming loop 40 through headrail 12 to move the loop 40 to the left-hand side. The cord 20 is tied to some mechanism 44 which directly controls the movement of the plurality of panels 14 so that, when the cord 20 is pulled in one direction, the covering 10 is closed, and, when the cord 20 is pulled in the other direction, the covering 10 is opened. The mechanism 44, as suggested above, may be any one of a variety of mechanisms known and used in the art, for the present invention may find application in shades and curtains in any of a number of different varieties.

For example, if the covering is of the stacking-panel type or is a curtain, mechanism 44 may be as shown in FIG. 7, so that, when cord 20 is pulled one way or the other, mechanism 44 is moved to the left or to the right to open or close the covering. On the other hand, if the covering is a roll-up shade, mechanism 44 may be a spool about which the two ends of cord 20 are wound in opposite directions, so that the spool may be rotated in one direction or the other when the cord 20 is pulled, the spool being in mechanical communication with a shaft around which the roll-up covering may be wound, to raise or lower the roll-up covering. Finally, if the covering is a Venetian blind, mechanism 44 may again be a spool about which the two ends of cord 20 are wound in opposite directions, so that the spool may be rotated in one direction or the other when cord 20 is pulled, the spool being in mechanical communication with a shaft around which lift cords for the Venetian blind may be wound, to raise or lower the Venetian blind. Alternatively, cord 20 may itself function as the lift cord by having each of its two ends extend downwardly from appropriately spaced openings in the headrail to the bottom rail of the Venetian blind. In this instance, one would pull both sides of loop 40 to raise the Venetian blind, and conventional means for maintaining the Venetian blind at a desired open position would additionally be required.

End caps 18 each have posts 42 which may be held within holes 22 in cord-guiding members 16 by interference fit to cover the cord-guiding members 16. Cord 20 emerges from within headrail 12 through holes 30, 32 in cord-guiding members 16. Holes 30, 32 are in recesses 46 so that, when the end caps 18 are in place, cord 20 may be freely manipulated. Recesses 46 also provide room for a tool, such as a screwdriver, to be inserted between cord-guiding member 16 and end cap 18 to pry end cap 18 away from cord-guiding member 16 to gain access to cord 20 as shown in FIG. 3 to change the location of loop 40 from one end of the covering 10 to the other.

In short, the present invention provides a straightforward and simple approach to changing the location of a cord loop used to operate a curtain, shade or the like without a complicated and time-consuming disassembly and without removal from above the architectural opening where it is installed.

Modifications to the above would be obvious to those of ordinary skill in the art, but would not bring the invention so modified beyond the scope of the appended claims.

What is claimed is:

1. A covering for an architectural opening, said covering comprising:

a headrail having an interior, a first end and a second end, said headrail being mountable above an architectural opening;

a first cord-guiding member and a second cord-guiding member; said first and second cord-guiding members being at said first and second ends of said headrail, respectively; both of said first and second cord-guiding members having a first hole and a second hole communicating with said interior of said headrail, said first and second holes being separated from one another in a horizontal direction, and further having a rotatable element between said first and second holes, said rotatable element being rotatable about a vertical axis;

material suspended from said headrail for covering said architectural opening;

a mechanism within said headrail for alternately covering and uncovering said architectural opening with said material; and a cord having first and second cord ends connected to each other at a single point on said mechanism for controlling said mechanism, said cord running from said first end at said mechanism within said headrail and outwardly through said first hole of said cord-guiding member at said first end of said headrail; then entering said headrail through said second hole of said cord-guiding member at said first end of said headrail and running lengthwise through said headrail and outwardly through said first hole of said cord-guiding member at said second end of said headrail; then reentering said headrail through said second hole of said cord-guiding member at said second end of said headrail and running to said second end at said mechanism, said cord forming a loop at one of said first and second ends of said headrail, whereby said cord may be manipulated to alternately cover and uncover said architectural opening with said material.

2. A. covering as claimed in claim 1 wherein said rotatable element between said first and second holes is a roller.

3. A covering as claimed in claim 1 wherein said rotatable element between said first and second holes is a pulley.

4. A covering as claimed in claim 1 further comprising a first end cap and a second end cap, said first end cap being attached to said first cord-guiding member and said second end cap being attached to said second cord-guiding member.

5. A covering as claimed in claim 1 wherein said first and second cord-guiding members further comprise a first and a second additional rotatable element beneath said first and second holes, respectively, said first and second additional rotatable elements being rotatable around a horizontal axis.

6. A covering as claimed in claim 5 wherein said first and second additional rotatable elements beneath said first and second holes are rollers.

7. A covering as claimed in claim 5 wherein said first and second additional rotatable elements beneath said first and second holes are pulleys.

8. A covering for an architectural opening, said covering comprising:

a headrail mountable above said architectural opening, covering material suspended from said headrail for covering said architectural opening, and a mechanism within said headrail for alternately covering and uncovering said architectural opening with said material; and a cord having first and second cord ends and being continuous therebetween, said first and second cord ends connected to each other at a single point on said mechanism for controlling said mechanism;

said cord including:

first and second opposing exterior cord segments extending exterior to said headrail at respective first and second opposing exterior ends of said headrail, both exterior cord segments being capable of alternatively defining a pullable loop segment which, when pulled, urges said cord at said connection point on said mechanism;

wherein, when one of said first and second exterior cord segments defines said pullable loop segment:

the other of said first and second exterior cord segments is retracted against the respective exterior end of said headrail; and said other of said cord segments is capable of being selectively drawn away from said respective exterior end of said headrail, whereby said other of said exterior cord segments becomes said pullable loop segment and said one of said exterior cord segments becomes retracted against the respective exterior end of said headrail.

9. The covering of claim 8, wherein said cord further includes first and second opposing internal cord segments extending within said headrail and connecting opposing ends of said first and second opposing external cord segments, one of said first and second internal cord segments including said first and second cord ends.

* * * * *